US011506061B2

(12) United States Patent
Poth, III et al.

(10) Patent No.: US 11,506,061 B2
(45) Date of Patent: Nov. 22, 2022

(54) RAM AIR TURBINE BLADE PLATFORM COOLING

(71) Applicant: Mechanical Dynamics & Analysis LLC, Latham, NY (US)

(72) Inventors: Leissner Ferdinand Poth, III, San Antonio, TX (US); Sanjay Surat Hingorani, Johns Creek, GA (US)

(73) Assignee: Mechanical Dynamics & Analysis LLC, Latham, NY (US)

( * ) Notice: Subject to any disclaimer, the term of this patent is extended or adjusted under 35 U.S.C. 154(b) by 153 days.

(21) Appl. No.: 16/993,808

(22) Filed: Aug. 14, 2020

(65) Prior Publication Data

US 2022/0049607 A1 Feb. 17, 2022

(51) Int. Cl.
*F01D 5/18* (2006.01)
*F01D 5/30* (2006.01)

(52) U.S. Cl.
CPC ..... *F01D 5/18* (2013.01); *F01D 5/30* (2013.01); *F05D 2220/34* (2013.01); *F05D 2230/00* (2013.01); *F05D 2240/30* (2013.01)

(58) Field of Classification Search
None
See application file for complete search history.

(56) References Cited

U.S. PATENT DOCUMENTS 5,848,876 A 12/1998 Tomita
6,139,269 A * 10/2000 Liang ..... F01D 5/20 415/115
6,190,130 B1 2/2001 Fukue et al.
6,402,471 B1 * 6/2002 Demers ..... F01D 11/04 416/193 A
6,416,284 B1 * 7/2002 Demers ..... F01D 5/186 416/193 A (Continued)

FOREIGN PATENT DOCUMENTS

JP 2002201906 7/2002
JP 2014114810 6/2014

(Continued)

OTHER PUBLICATIONS

European Search Report and Written Opinion issued in corresponding EP Application 21182704.3, completed Dec. 16, 2021.

(Continued)

*Primary Examiner* — Kayla Mccaffrey
(74) *Attorney, Agent, or Firm* — Burris Law, PLLC

(57) ABSTRACT

A turbine rotor blade includes an airfoil, root, and platform that is between the root and a proximate end portion of the airfoil. The blade defines a passage having a first leg, second leg, and arcuate portion. The arcuate portion is at least partially within the platform and connects the first and second legs. The first leg extends between a distal end portion of the airfoil and an inlet of the arcuate portion. The second leg extends from an outlet of the arcuate portion to the distal end portion of the airfoil. The platform includes a first feed passage and branch passages. The first feed passage is open through an extrados of the arcuate portion and is in fluid communication with the branch passages. The inlet of each branch passage is connected with the first feed passage while the outlet is open to an exterior of the platform.

24 Claims, 9 Drawing Sheets

(56) References Cited

U.S. PATENT DOCUMENTS

| | | | | |
|---|---|---|---|---|
| 7,309,212 | B2 * | 12/2007 | Itzel | F01D 5/082 416/193 A |
| 8,133,024 | B1 * | 3/2012 | Liang | F01D 5/187 415/115 |
| 9,121,292 | B2 * | 9/2015 | Zhang | F01D 5/187 |
| 10,001,013 | B2 | 6/2018 | VanTassel et al. | |
| 10,196,903 | B2 | 2/2019 | Benson et al. | |
| 10,364,682 | B2 * | 7/2019 | Hough | F01D 5/187 |
| 10,633,977 | B2 * | 4/2020 | Takamura | B22C 9/10 |
| 11,047,241 | B2 * | 6/2021 | Gayman | F01D 5/187 |
| 2007/0201979 | A1 | 8/2007 | Veltre et al. | |
| 2012/0082566 | A1 | 4/2012 | Ellis et al. | |
| 2012/0107135 | A1 * | 5/2012 | Harris, Jr. | F01D 5/187 29/889.721 |
| 2013/0052009 | A1 * | 2/2013 | Smith | F01D 5/187 416/97 R |
| 2013/0115101 | A1 * | 5/2013 | Walunj | F01D 5/187 416/97 R |
| 2013/0171003 | A1 * | 7/2013 | Ellis | F01D 5/187 416/97 R |
| 2014/0114810 | A1 | 4/2014 | Mehta et al. | |
| 2017/0204730 | A1 | 7/2017 | Benson et al. | |
| 2018/0187554 | A1 | 7/2018 | Hough et al. | |

FOREIGN PATENT DOCUMENTS

| | | |
|---|---|---|
| JP | 2015169209 | 9/2015 |
| JP | 2017057750 | 3/2017 |

OTHER PUBLICATIONS

Office Action regarding Japanese Patent Application No. 2021-131103, dated Jul. 26, 2022, and English translation thereof.

* cited by examiner

RAM AIR TURBINE BLADE PLATFORM COOLING

FIELD

The present disclosure relates to cooling in turbomachinery and more specifically to cooling of blade platforms.

BACKGROUND

The statements in this section merely provide background information related to the present disclosure and may not constitute prior art.

Turbine components (e.g., blades or vanes) operate in high-temperature environments. Providing adequate cooling of the turbine components can be important to increasing component lifespan. Cooling of the turbine component may be provided by the use of compressed air that flows through various passages within, and exiting, the turbine component (e.g., a turbine blade). Use of compressed air for purposes other than combustion (e.g., for component cooling) can result in a decrease of engine efficiency as its use is a loss of the work expended to compress the air.

One area that has been found to be sensitive to thermal induced fatigue from the normal starts and stops of the turbine is the turbine blade platform. It has been found that cooling the turbine blade platform can improve the operational durability of the turbine blade. However, existing configurations for cooling the turbine blade platform can suffer from inadequate cooling, lower efficiency, and back flow of hot combustion gas due to inadequate feed pressure.

The present disclosure addresses these and other issues associated with cooling of turbine components.

SUMMARY

This section provides a general summary of the disclosure and is not a comprehensive disclosure of its full scope or all of its features.

In one form of the present disclosure, a turbine rotor blade includes an airfoil, a root, and a platform. The platform is disposed at an interface between the root and a proximate end portion of the airfoil. The turbine rotor blade defines at least one interior cooling passage having a first leg, a second leg, and an arcuate portion. The arcuate portion is disposed at least partially within the platform and connects the first and second legs. The first leg extends between a distal end portion of the airfoil and an inlet of the arcuate portion. The second leg extends from an outlet of the arcuate portion to the distal end portion of the airfoil. The platform includes a first feed passage and a plurality of branch passages. The first feed passage includes an inlet open through an extrados of the arcuate portion. The first feed passage is in fluid communication with the plurality of branch passages. Each branch passage of the plurality of branch passages has an inlet and an outlet. The inlet of each branch passage is connected for fluid communication with the first feed passage. The outlet of each branch passage is open to an exterior of the platform. According to a variety of alternative configurations: the inlet of the first feed passage is open to a high-pressure region of a flowpath of the arcuate portion; the inlet of the first feed passage is located radially inward of the plurality of branch passages; the first feed passage extends from the inlet of the first feed passage in a direction toward a leading wall of the platform; the inlet of the first feed passage is located along the extrados of the arcuate portion closer to the second radial passage than the first radial passage; the platform includes a second feed passage, an inlet of the second feed passage being open to the first feed passage, wherein the inlet of each branch passage is open to the second feed passage; an entirety of the first feed passage is disposed radially inward of the plurality of branch passages; the second feed passage includes an outlet open to the exterior of the platform, wherein the platform includes a plug disposed in the outlet of the second feed passage and blocking flow from exiting the platform via the outlet of the second feed passage; the first feed passage includes an outlet open to the exterior of the platform, wherein the platform includes a plug disposed in the outlet of the first feed passage and blocking flow from exiting the platform via the outlet of the first feed passage; the outlet of the first feed passage is located at a leading wall of the platform; the outlet of each branch passage is disposed on a suction side wall of the platform; the outlet of each branch passage is arranged such that cooling gas exiting the outlets of the branch passages impinges on a pressure side wall of a platform of an adjacent turbine rotor blade when installed on a turbine rotor; the outlet of each branch passage is disposed along a portion of the platform that is proximate a leading wall of the platform.

In another form, a method of cooling a turbine rotor includes directing a flow of cooling fluid through an inlet of an interior cooling passage of a turbine rotor blade, the inlet of the interior cooling passage being disposed in a root of the turbine rotor blade. The method includes directing the flow of cooling fluid along a first leg of the interior cooling passage, the first leg extending from a tip portion of an airfoil of the turbine rotor blade in a radially inward direction. The method further includes directing the flow of cooling fluid from the first leg to an inlet of an arcuate portion of the interior cooling passage. The method also includes directing a first portion of the flow of cooling fluid from the arcuate portion to a second leg of the interior cooling passage, the second leg extending from an outlet of the arcuate portion in a radially outward direction. The method additionally includes directing a second portion of the flow of cooling fluid from the arcuate portion to a first feed passage via an aperture an aperture defined in an extrados of the arcuate portion. The method further includes directing the second portion of the flow of cooling fluid through a plurality of branch passages defined by a platform of the turbine rotor blade, each branch passage having an outlet open to an exterior of the platform. According to a variety of alternate configurations: the method further includes directing the second portion of the flow of cooling fluid from the first feed passage to a second feed passage, the second feed passage being directly open to the first feed passage and each branch passage; the first feed passage is disposed radially inward of the branch passages; the method further includes directing at least some of the second portion of the flow of cooling fluid to flow from the branch passages and impinge on a platform of an adjacent turbine rotor blade.

In yet another form, a method of forming a platform cooling arrangement in a turbine rotor blade includes providing a turbine rotor blade comprising an airfoil, a root, and a platform disposed at an interface between the root and a proximate end portion of the airfoil, the turbine rotor blade defining an interior cooling passage having a first leg, a second leg, and a curved portion, the curved portion disposed at least partially within the platform and connecting the first and second legs, the first leg extending between a distal end portion of the airfoil and an inlet of the curved portion, the second leg extending from an outlet of the curved portion to the distal end portion of the airfoil. The method further includes forming a first feed passage in the platform such that an inlet of the first feed passage is open through an extrados of the curved portion and forming a plurality of branch passages such that each branch passage has an inlet in fluid communication with the first feed passage and an outlet open to an exterior of a suction side wall of the platform. According to a variety of alternative configurations: the first feed passage extends from the inlet of the first feed passage in a direction toward a leading wall of the platform; the method further includes forming a second feed passage in the platform, an inlet of the second feed passage being open to the first feed passage, wherein the inlet of each branch passage is open to the second feed passage.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
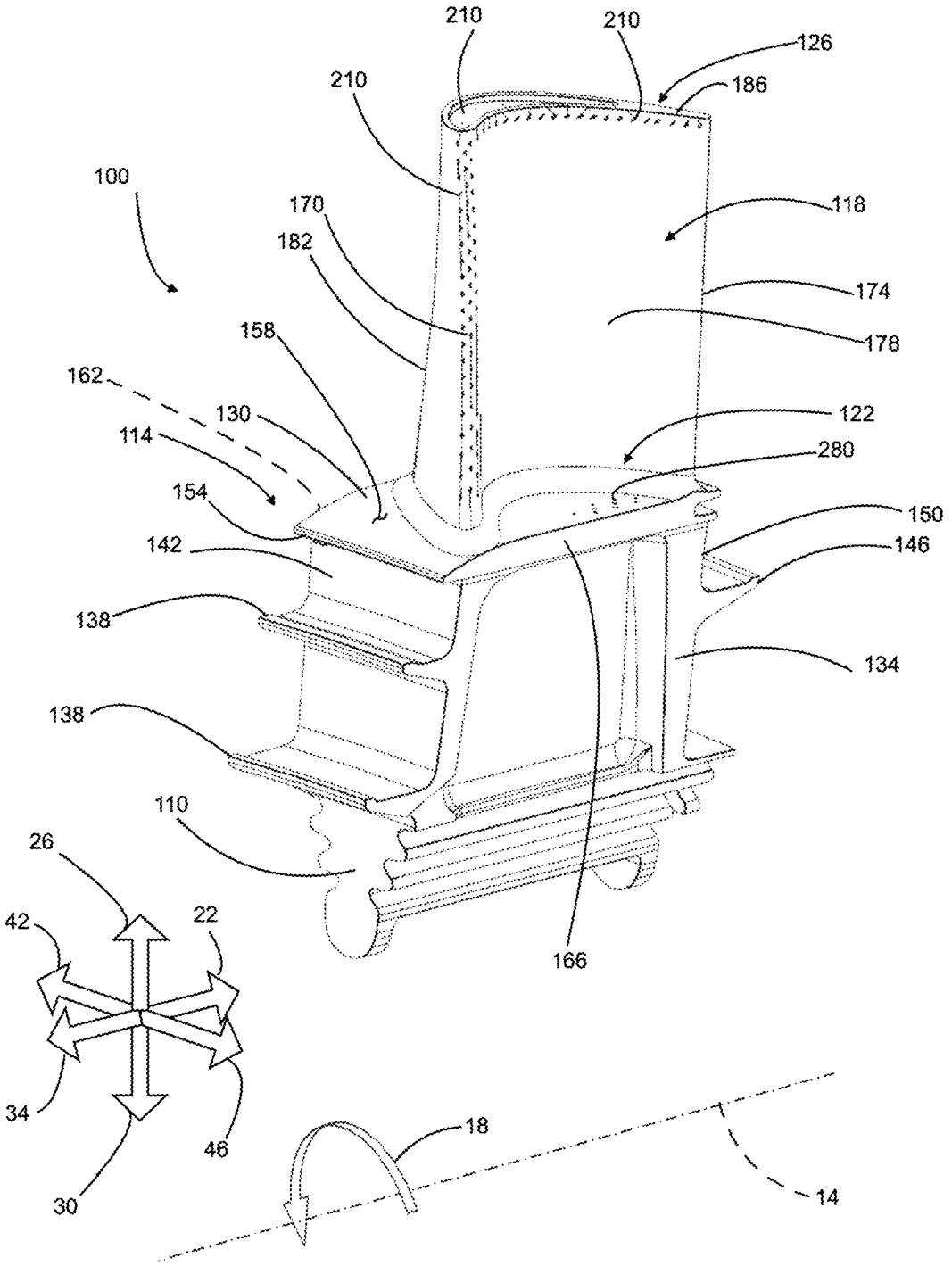
FIG. 1 is a perspective view of a turbine blade in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, an example turbine component 100 is illustrated. In the example provided, the turbine component 100 is a turbine rotor blade and is also referred to herein as the turbine rotor blade 100 or the turbine blade 100. Although described herein with reference to a blade of a turbine rotor, the turbine component 100 may alternatively be a stator vane. The turbine blade 100 is configured to be mounted on a rotor 10 (FIG. 9) of a turbine (not shown) such that the turbine blade 100 rotates about a rotational axis 14 in a rotational direction 18 and the main airflow through the turbine (not shown) is generally along direction 22, also referred to herein as the aft direction 22.

Figure 9:
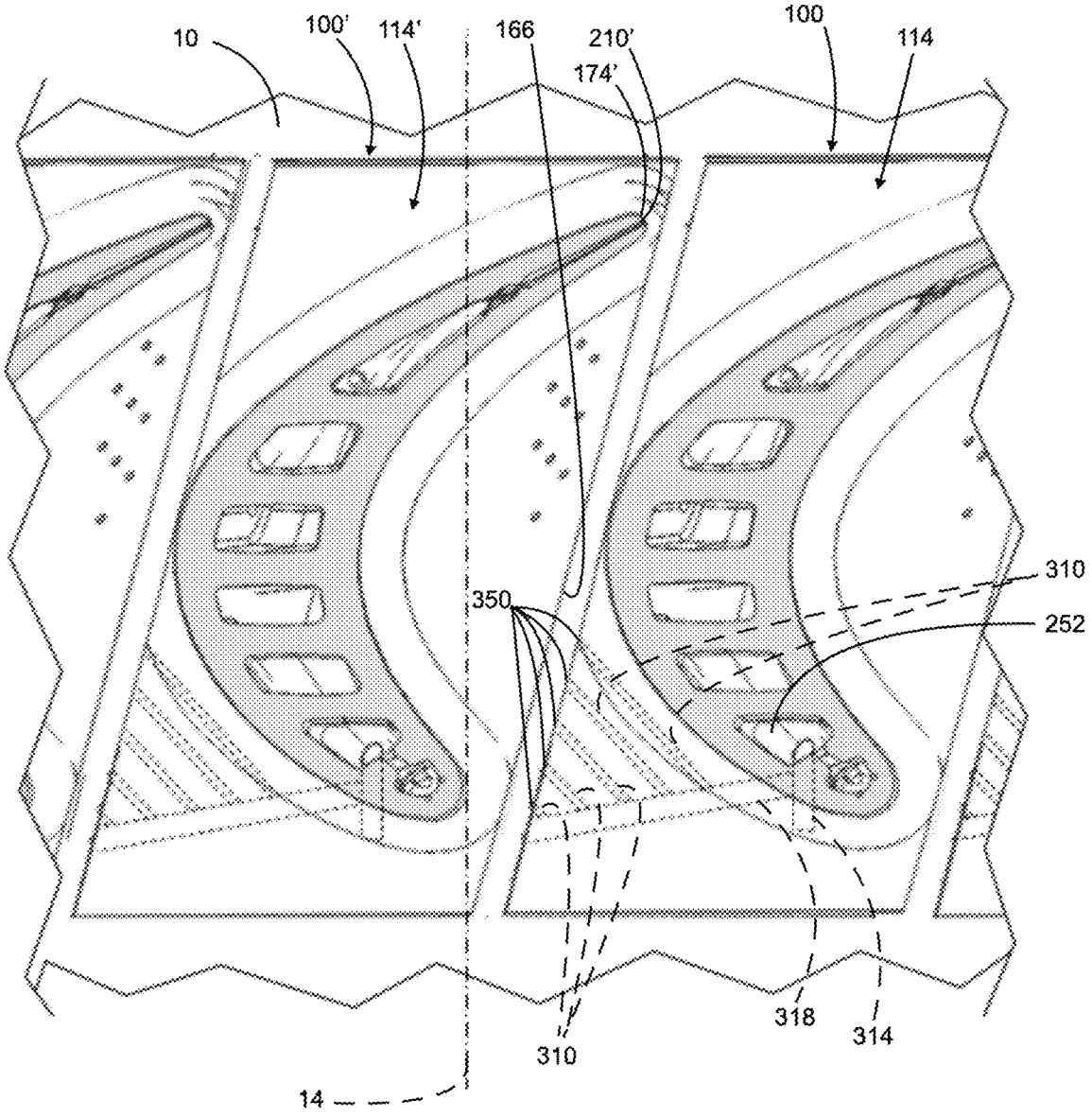
FIG. 9 is a top cross-sectional view of the turbine blade of FIG. 1, illustrating the turbine blade in an installed orientation on a turbine rotor relative to a second turbine blade in accordance with the teachings of the present disclosure.

The turbine blade 100 includes a root 110 a platform 114 and an airfoil 118. The root 110 is configured to couple the turbine blade 100 to the rotor 10 (FIG. 9). In the example provided, the root 110 is a shape typically referred to as a dovetail or fir tree and is configured to be received in a mating channel (not shown) of the rotor 10 (FIG. 9), though other configurations can be used. The platform 114 is disposed at an interface between the root 110 and a proximal end portion 122 of the airfoil 118 such that the airfoil 118 extends radially outward (i.e., in direction 26) from the proximal end portion 122 at the platform 114 to a distal end portion 126 (also referred to herein as a tip portion). The root 110 extends radially inward (i.e., in direction 30) from the platform 114. The platform 114 includes a base portion 130 and a shank portion 134. The airfoil 118 extends from the base portion 130 while the root 110 extends from the shank portion 134. The platform 114 can also include a plurality of wings that extend from the shank portion 134 such as one or more forward wings 138 extending in the forward direction 34 from a forward wall 142 (i.e., a leading wall) of the shank portion 134 and one or more aft wings 146 extending in the aft direction 22 from an aft wall 150 of the shank portion 134.

In the example provided, a forward wall 154 (i.e., a leading wall) of the base portion 130 overhangs the forward wall 142 in the forward direction 34. The airfoil 118 extends from a top surface 158 of the base portion 130 that faces generally radially outward. The base portion 130 also has a suction side wall 162 that faces in direction 42 and a pressure side wall 166 that faces in direction 46.

The airfoil 118 has a leading edge 170, a trailing edge 174, a pressure side surface 178, and a suction side surface 182. The leading edge 170 generally faces in the forward direction 34 and the trailing edge 174 generally faces in the aft direction 22. The suction side surface 182 is a convex curved shape that generally faces in the direction 42 and the pressure side surface 178 is a concave curved shape that generally faces in the direction 46. The airfoil 118 defines a plurality of airfoil cooling apertures 210. In the example provided, the airfoil cooling apertures 210 are arranged to permit cooling air to exit the airfoil 118 along the leading edge 170, from a blade tip 186 (e.g., a tip cap) of the distal end portion 126, along the pressure side surface 178 at the distal end portion 126 and along the trailing edge 174, though other configurations can be used.

Figure 2:
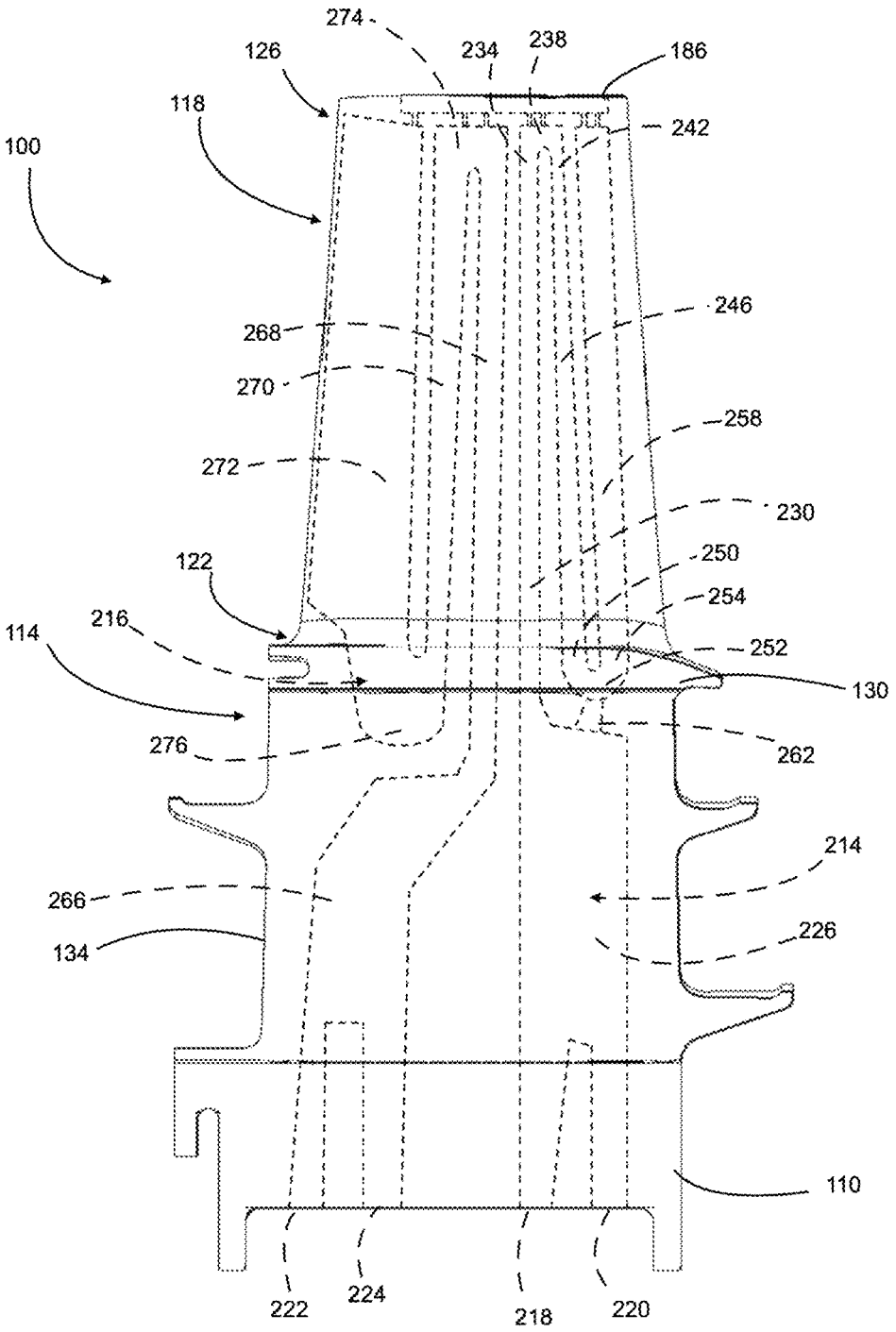
FIG. 2 is a side view of the turbine blade of FIG. 1, illustrating a plurality of airfoil cooling passages within the turbine blade in accordance with the teachings of the present disclosure.

Referring to FIG. 2, the turbine blade 100 defines a plurality of internal cooling passages 214, 216 in fluid communication with the airfoil cooling apertures 210 (FIG. 1). The internal cooling passages 214, 216 have inlets 218, 220, 222, 224 located in the root 110 configured to receive pressurized air from the rotor 10 (FIG. 9). In the example provided, the cooling passage 214 includes a plenum chamber 226 in the shank portion 134 that receives cooling air from the inlets 218 and 220. The plenum chamber 226 provides the air to a leg 230 of the cooling passage 214 that extends radially outward through the base portion 130 into the airfoil 118 and extends to the distal end portion 126 of the airfoil 118. At the distal end portion 126 of the airfoil 118, the leg 230 is connected to an inlet 234 of an arcuate portion 238 (e.g., a curved portion) of the cooling passage 214. The arcuate portion 238 curves back radially inward and an outlet 242 of the arcuate portion 238 is connected to another leg 246 of the cooling passage 214 that extends radially inward toward the platform 114. In the example provided, some of the airfoil cooling apertures 210 (FIG. 1) in the blade tip 186 may be open to the arcuate portion 238.

The leg 246 extends from the distal end portion 126 to the proximal end portion 122. The leg 246 is connected to an inlet 250 of another arcuate portion 252 of the cooling passage 214 that is located at least partially in the platform 114. In the example provided, the arcuate portion 252 is entirely in the platform 114, though other configurations can be used such as being partially in the proximal end portion 122 of the airfoil 118 for example. The inlet 250 is open in the radially outward direction 26 (FIG. 1). The arcuate portion 252 curves back up so that an outlet 254 of the arcuate portion 252 is also open in the radially outward direction 26 (FIG. 1). The outlet 254 is further in the forward direction 34 (FIG. 1) than the inlet 250. The outlet 254 is connected to another leg 258 of the cooling passage 214. The leg 258 extends radially outward toward the distal end portion 126. In the example provided, the leg 258 extends fully to the blade tip 186 and is open to the airfoil cooling apertures 210 (FIG. 1) along the leading edge 170 (FIG. 1) and may also be open to some of the airfoil cooling apertures 210 (FIG. 1) at the blade tip 186, though other configurations can be used. In the example provided, an additional passageway 262 can optionally connect directly from the plenum chamber 266 to the arcuate portion 252.

In the example provided, the cooling passage 216 similarly includes a second plenum chamber 266 that receives air from the inlets 222, 224 and provides the air to a series of legs 268, 270, 272 and arcuate portions 274, 276 that wind through the airfoil 118 and the platform 114. The cooling passage 216 is aft of the cooling passage 214 and can be connected to some of the airfoil cooling apertures 210 (FIG. 1) in the blade tip 186 and to the airfoil cooling apertures 210 in the trailing edge 174 (e.g., the air foil cooling apertures 210' shown in FIG. 9). The cooling passage 216 and/or 214 can also optionally provide air to cooling apertures open through the top surface 158 (FIG. 1) of the platform 114 such as platform cooling apertures 280 (FIG. 1) disposed between the pressure side wall 166 (FIG. 1) and the pressure side surface 178 (FIG. 1), though other configurations can be used.

Figure 5:
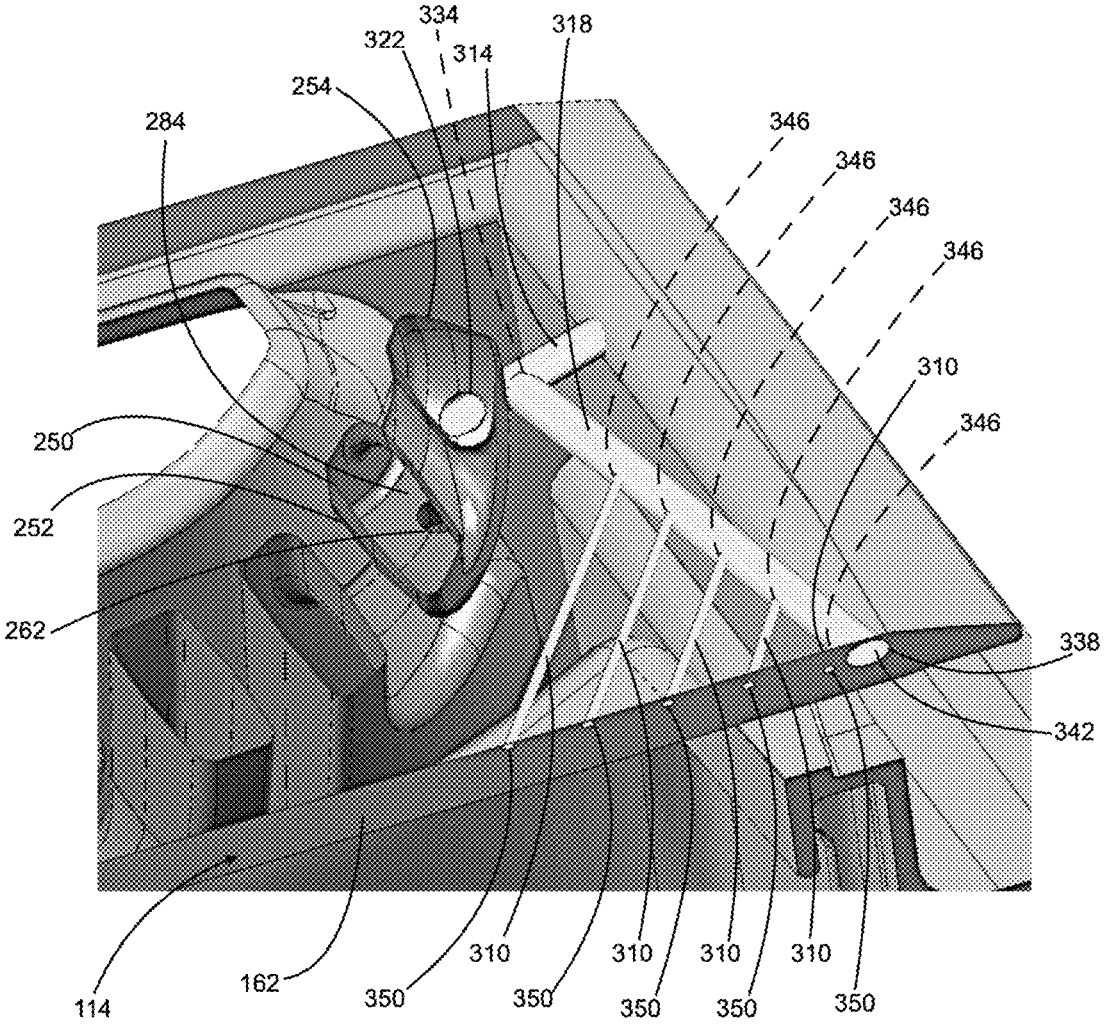
FIG. 5 is a perspective cut-away view of the turbine blade of FIG. 1, illustrating surfaces that form the blade and platform cooling passages of FIGS. 2 and 5.

Referring to FIG. 5, the platform 114 defines a plurality of branch passages 310 and at least one feed passage that couples the branch passages 310 to an extrados 284 of the arcuate portion 252. In the example provided, two bores within the platform 114 define a first feed passage 314 and a second feed passage 318. The first feed passage 314 has an inlet 322 open directly through the extrados 284 of the arcuate portion 252.

Figure 3:
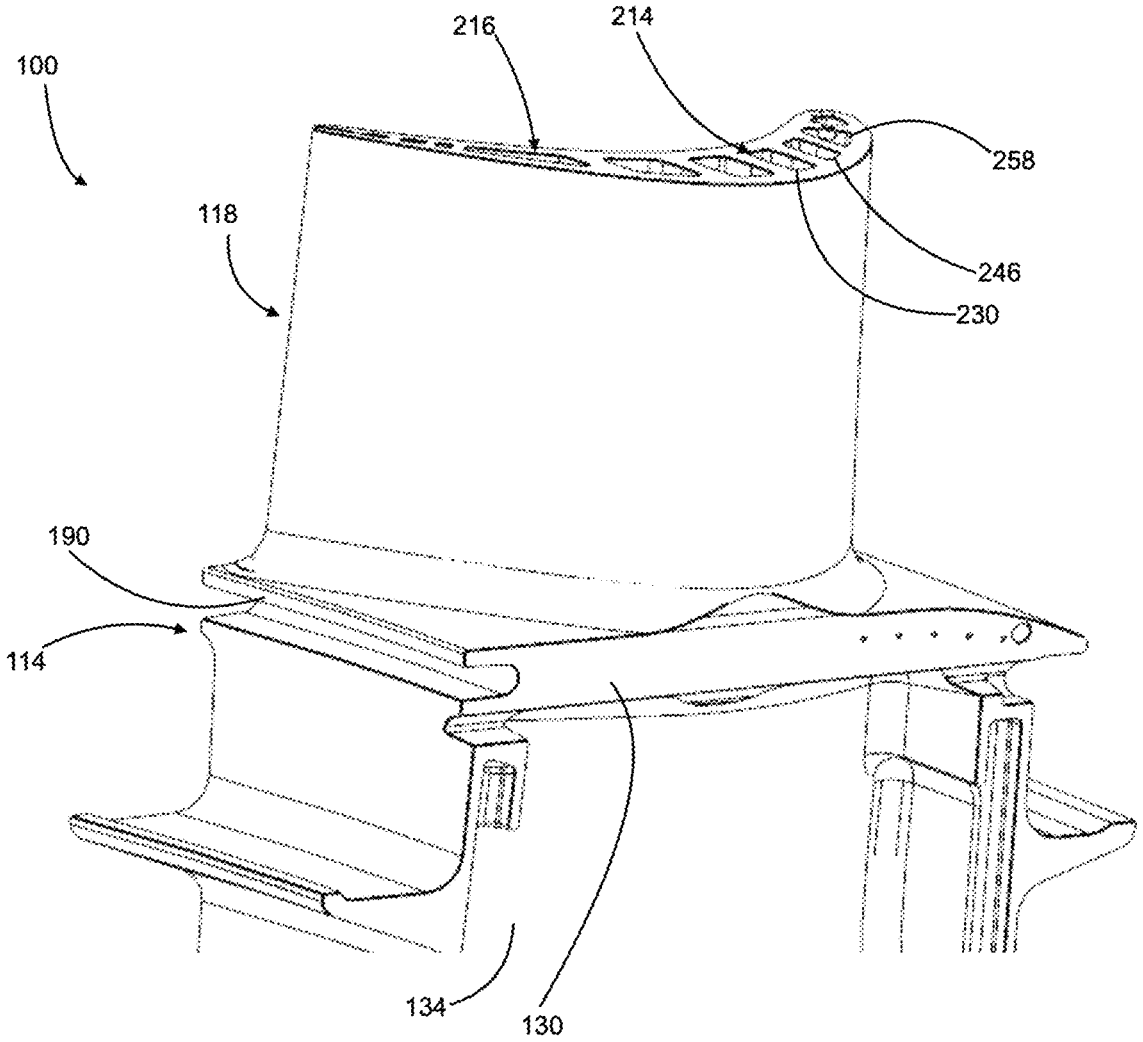
FIG. 3 is a perspective view of a portion of the turbine blade of FIG. 1.
Figure 4:
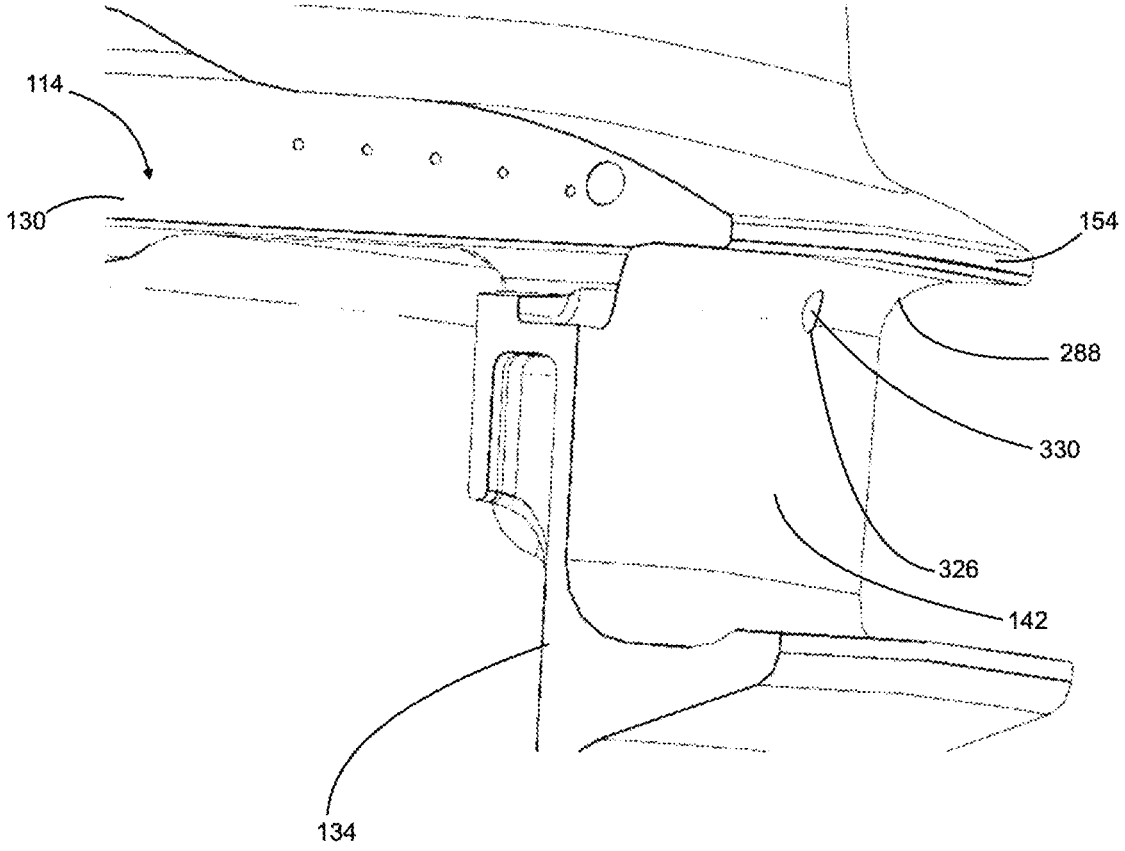
FIG. 4 is a perspective view of a portion of the turbine blade of FIG. 1, illustrating a plurality of platform cooling passages in accordance with the teachings of the present disclosure.

With continued reference to FIG. 5 and additional reference to FIGS. 3 and 4, the first feed passage 314 extends from the inlet 322 to a first end aperture 326 through a forward (i.e., leading) facing wall (e.g., forward wall 142 or 154) of the platform 114. In the example provided, the first end aperture 326 is in the forward wall 142 of the shank portion 134 of the platform 114. In the example provided, the first end aperture 326 is through a fillet 288 that transitions the forward wall 142 of the shank portion 134 to the overhanging forward wall 154 of the base portion 130, though other configurations can be used such as being entirely or partially radially inward of the fillet 288 for example. In an alternative configuration, not shown, the first end aperture 326 can be partially or entirely open through the forward wall 154 of the base portion 130.

In the example provided, the first feed passage 314 is a straight, cylindrical passage, though other configurations can be used. In an alternative configuration, the first feed passage 314 can curve and/or can vary in diameter along its length. The first end aperture 326 is plugged or blocked so that air received in the first feed passage 314 from the inlet 322 cannot exit through the first end aperture 326. In the example provided, a plug 330 is inserted into the first end aperture 326 and brazed or welded therein, though other configurations can be used to plug the first end aperture 326.

Figure 6:
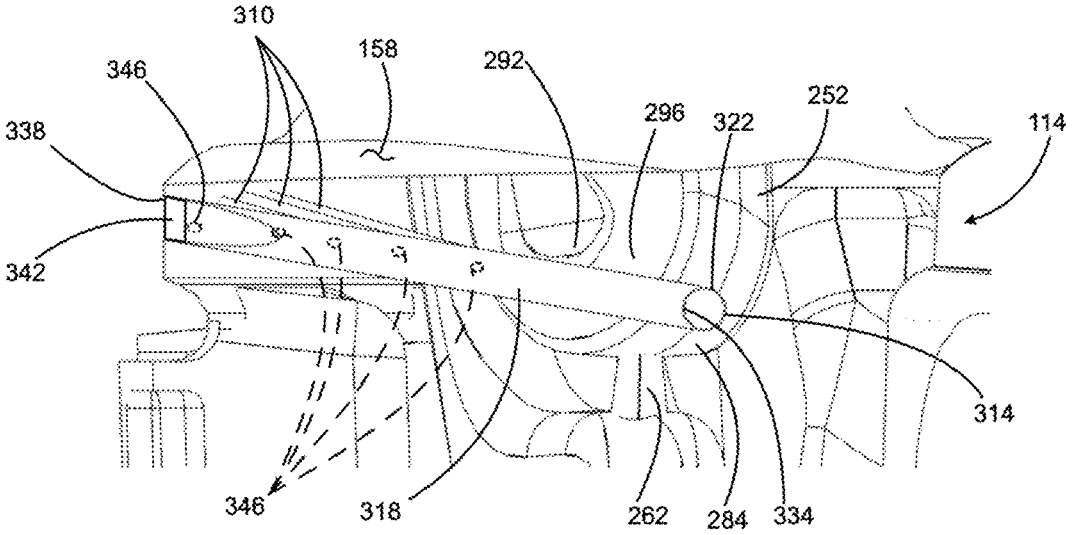
FIG. 6 is a side cut-away view of a portion of the turbine blade of FIG. 1, illustrating surfaces that form the blade and platform cooling passages of FIGS. 2 and 5.

Referring to FIGS. 5 and 6, the second feed passage 318 has an inlet 334 open to the first feed passage 314 and extends therefrom to a second end aperture 338 through the suction side wall 162. The inlet 334 is radially inward of the second end aperture 338. In the example provided, the second feed passage 318 is a straight, cylindrical passage, though other configurations can be used. In an alternative configuration, the second feed passage 318 can curve and/or can vary in diameter along its length. In the example provided, the second feed passage 318 has a diameter equal to that of the first feed passage 314, though other configurations can be used.

In the example provided, the second end aperture 338 is plugged or blocked so that air received in the second feed passage 318 from the first feed passage 314 cannot exit through the second end aperture 338. In the example provided, a plug 342 is inserted into the second end aperture 338 and brazed or welded therein, though other configurations can be used to plug the second end aperture 338. In another configuration, the second end aperture 338 can remain open such that air can exit therethrough.

Referring to FIG. 5, each branch passage 310 includes an inlet 346 open to the second feed passage 318 to receive air therefrom. Each branch passage 310 can have a diameter that is less than that of the second feed passage 318. The diameters of the branch passages 310 may be equal to each other or may differ. Each branch passage 310 extends from the second feed passage 318 to a corresponding branch outlet 350 open through the suction side wall 162. In the example provided, each branch outlet 350 is aft of its respective inlet 346 and the second end aperture 338, though other configurations can be used, such as one or more of the branch outlets 350 being forward thereof for example.

Referring to FIGS. 5 and 6, in the example provided, each branch outlet 350 is radially outward of its corresponding inlet 346, though other configurations can be used. In the example provided, each branch passage 310 is a straight, cylindrical passage, though other configurations can be used. In an alternative configuration, one or more of the branch passages 310 can curve and/or can vary in diameter along its length. While the example provided is illustrated with five branch passages 310, more or fewer branch passages may be used. In the example provided, an entirety of the first feed passage 314 is located radially inward of the branch passages 310, though other configurations can be used.

Figure 7:
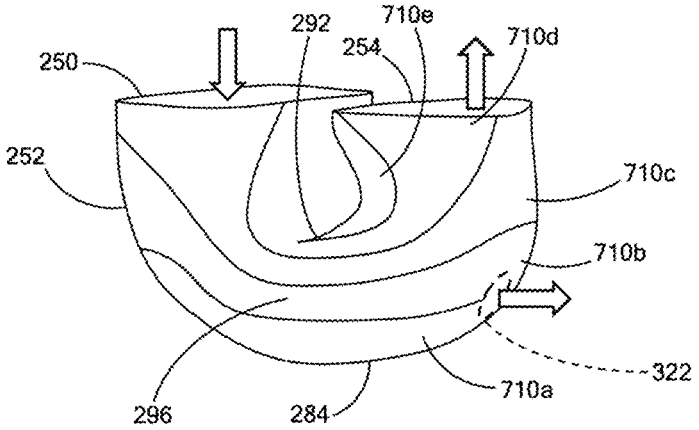
FIG. 7 is a perspective view of an arcuate portion of the blade cooling passages of FIG. 2, illustrating regions of flow pressure through the arcuate portion.

Referring to FIG. 7, the arcuate portion 252 is illustrated showing a distribution of pressure regions 710*a*, 710*b*, 710*c*, 710*d*, and 710*e* (only five pressure regions are specifically shown and labeled for ease of illustration; all of the pressure regions, including 710*a*, 710*b*, 710*c*, 710*d*, and 710*e* are collectively referred to herein as the pressure regions 710). The pressure regions 710 illustrate the pressure of the air flowing through the arcuate portion 252 during operation. The pressure of the air flow generally increases with proximity to the extrados 284 and decreases with proximity to the intrados 292 of the arcuate portion 252. For example, the pressure at pressure region 710*a* is higher than at pressure region 710*b*, which is higher than at pressure region 710*c*, and so on.

The inlet 322 of the first feed passage 314 (FIGS. 5 and 6) is located along the extrados 284 in an area of relatively higher pressure such as pressure regions 710*a* and 710*b* such that the inertia of the airflow provides a ram air effect for supplying air into the first feed passage 314 (FIGS. 5 and 6). In the example provided, the inlet 322 is located along the extrados 284 closer to the outlet 254 than the inlet 250, e.g., along a downstream half of the extrados 284, though other configurations can be used. While illustrated in one particular location along the extrados 284, the inlet 322 can be located along the extrados 284 in other locations within high pressure areas. Furthermore, the entirety of the inlet 322 does not need to be open through the extrados 284; for example, a portion of the inlet 322 being open through a side wall 296 of the arcuate portion 252 that is between the intrados 292 and the extrados 284.

Figure 8:
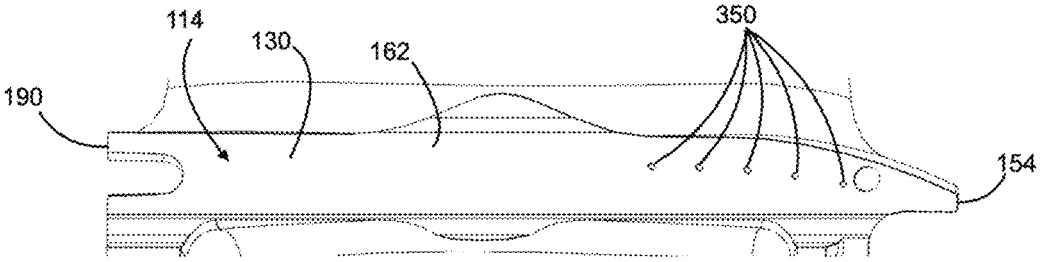
FIG. 8 is a side view of a platform of the turbine blade of FIG. 1.

Referring to FIG. 8, the branch outlets 350 may optionally be located such that the branch outlets 350 become more radially outward with increased distance from the forward wall 154 of the base portion 130. Alternatively, the branch outlets 350 may be located in other manners such as being aligned radially relative to the rotational axis 14 (FIG. 1) or positioned in other distributions relative to each other along the suction side wall 162. In the example provided, the branch outlets 350 are disposed along a portion of the platform 114 that is closer to the forward wall 154 than an aft wall 190 of the base portion 130 of the platform 114, though other configurations can be used.

Referring to FIG. 9, the turbine blade 100 is illustrated in an installed position relative to another turbine blade 100' adjacent thereto on the rotor 10. The turbine blade 100' is similar to the turbine blade 100 and similar features are denoted with similar but primed reference numerals. As described above, the first feed passage 314, the second feed passage 318, and the branch passages 310 are all in fluid communication with each other such that cooling air flows from the arcuate portion 252 to the branch outlets 350. The suction side wall 162 of the turbine blade 100 is spaced apart from and faces (i.e., opposes) the pressure side wall 166' of the adjacent turbine blade 100'. The branch outlets 350 are open to the exterior of the platform 114 and positioned to direct the cooling air onto the pressure side wall 166' of the platform 114' of the adjacent turbine blade 100' to cool the platform 114' of the adjacent turbine blade 100'.

Referring back to FIG. 6, at least a portion of the extrados 284 of the arcuate portion 252 can be disposed in the platform 114. As described above, the inlet 322 can be radially inward of the branch outlets 350 (FIG. 5). Accordingly, the feed passages 314 and 318 and the branch passages 310 can extend generally radially upwards to reach the branch outlets 350 (FIG. 5). This configuration maintains the cooling air away from the top surface 158 as it travels to the branch outlets 350 (FIG. 5). Thus, the cooling air is maintained away from the hot combustion gases and remains cooler.

Figure 10:
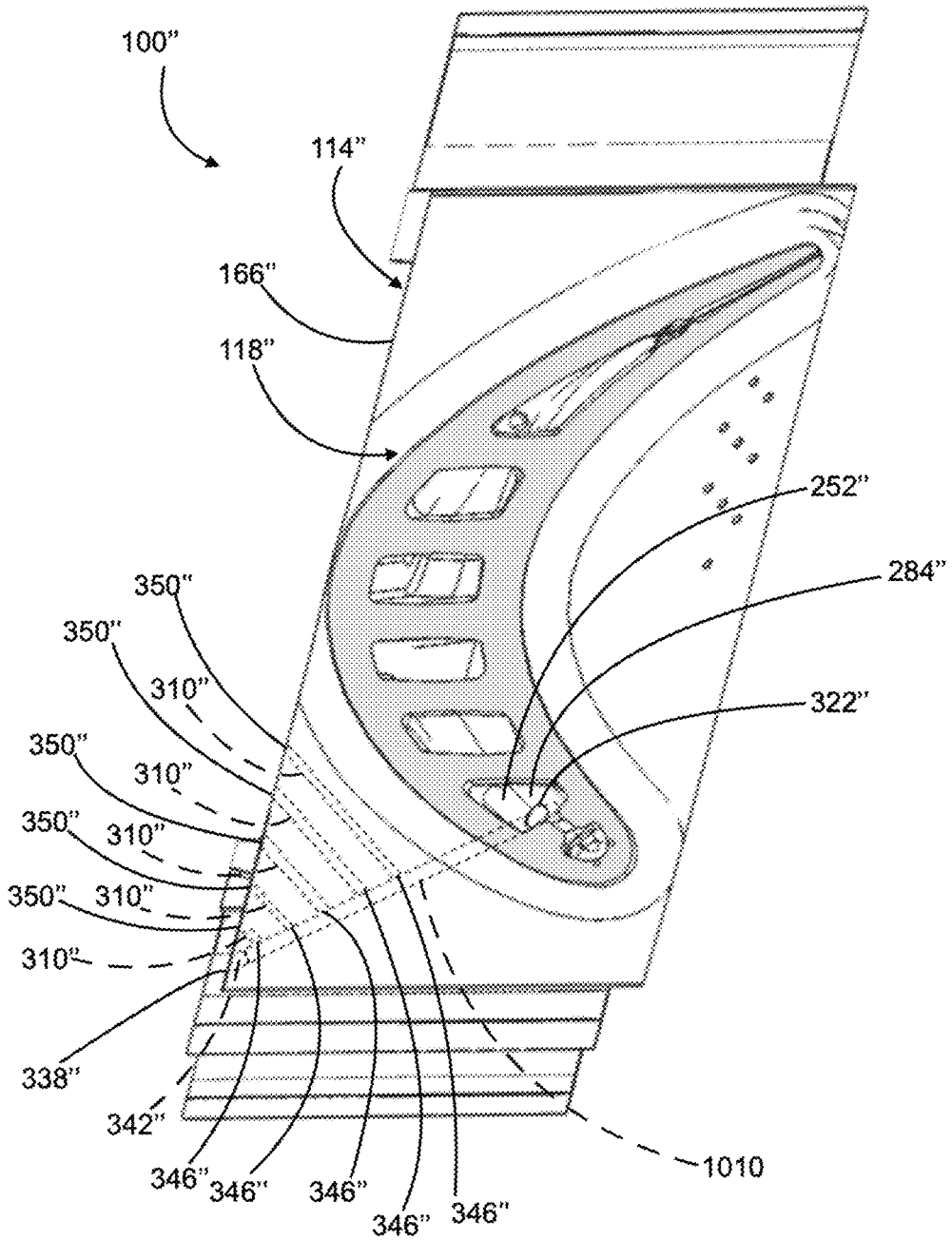
FIG. 10 is a top cross-sectional view of a turbine blade of a second configuration in accordance with the teachings of the present disclosure.

Referring to FIG. 10, a turbine blade 100" of an alternative configuration is illustrated. The turbine blade 100" is similar to the turbine blade 100 (FIGS. 1-9) except as otherwise shown or described herein. Similar features are described with similar but double primed reference numerals and only differences are described in detail herein. The turbine blade 100" includes only a single feed passage 1010. The single feed passage 1010 includes an inlet 322" that is similar to the inlet 322 (FIGS. 5, 7, and 9) and located along the extrados 284" of the arcuate portion 252". The feed passage 1010 extends from the inlet 322" to an end aperture 338" in the pressure side wall 166". The branch passages 310" each have an inlet 346" open directly into the feed passage 1010 and a branch outlet 350" open through the pressure side wall 166". The end aperture 338" can be similar to the end aperture 338 (FIGS. 3-6, 8 and 9) and can be similarly plugged with a plug 342". The branch outlets 350" can be similar to the branch outlets 350 (FIGS. 3-5, 8 and 9).

Figure 11:
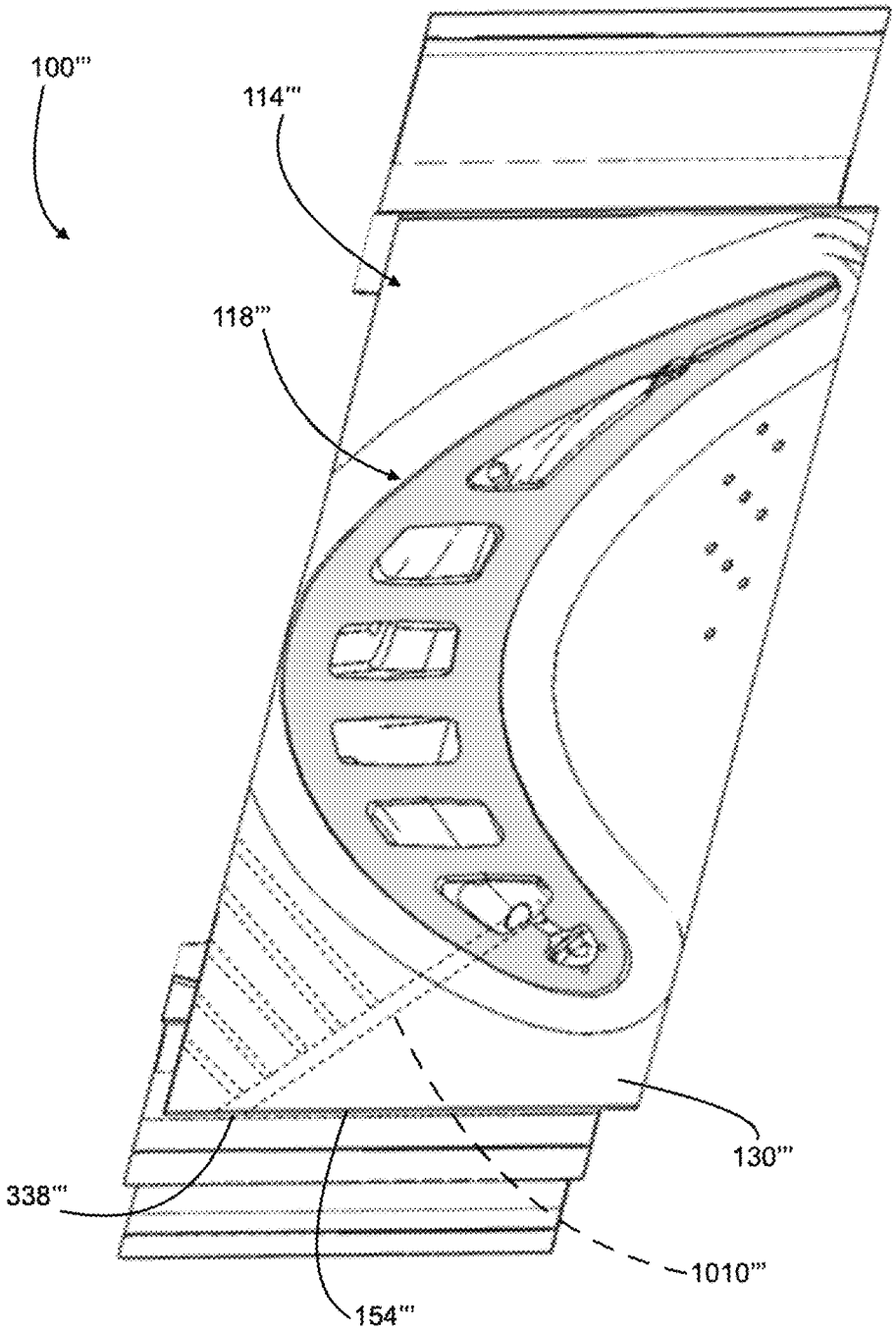
FIG. 11 is a top cross-sectional view of a turbine blade of a third configuration in accordance with the teachings of the present disclosure.

Referring to FIG. 11, a turbine blade 100'" of yet another configuration is illustrated. The turbine blade 100'" is similar to the turbine blade 100" except as otherwise shown or described herein. Similar features are denoted with similar but triple primed reference numerals and only differences are described in detail herein. In the example provided, the end aperture 338" is located in the forward wall 154'" of the base portion 130". In an alternative configuration, not specifically shown, the end aperture 338" can be located in the forward wall of the shank portion of the platform 114'" (not specifically visible in FIG. 11, but similar to the forward wall 142 shown in FIG. 4).

In one configuration, the feed passage(s) 314, 318, 1010, 1010'" and the branch passages 310, 310", 310'" are drilled into the platform 114, 114", 114'", though other methods of forming them can be used. Some non-limiting examples include being formed using electro-discharge machining (EDM), being cast in place, or the turbine blade 100, 100", 100'" can be 3-D printed to include the feed passage(s) 314, 318, 1010, 1010'" and the branch passages 310, 310", 310". In one configuration, an existing turbine blade 100, 100", 100'" can be retrofitted to include the feed passage(s) 314, 318, 1010, 1010'" and the branch passages 310, 310", 310". In another configuration, the feed passage(s) 314, 318, 1010, 1010'" and the branch passages 310, 310", 310" can be formed during the initial manufacturing of the turbine blade 100, 100", 100'".

Accordingly, a method of forming a platform cooling arrangement in a turbine rotor blade according to the teachings of the present disclosure includes providing a turbine rotor blade including an airfoil, a root, and a platform disposed at an interface between the root and a proximate end portion of the airfoil. The turbine rotor blade can define an interior cooling passage having a first leg, a second leg, and a curved (e.g., arcuate) portion. The curved portion can be disposed at least partially within the platform and connecting the first and second legs. The first leg can extend between a distal end portion of the airfoil and an inlet of the curved portion. The second leg can extend from an outlet of the curved portion to the distal end portion of the airfoil. The method can further include forming a first feed passage in the platform such that an inlet of the first feed passage is open through an extrados of the curved portion, and forming a plurality of branch passages such that each branch passage has an inlet in fluid communication with the first feed passage and an outlet open to an exterior of a suction side wall of the platform. The method can also include forming the first feed passage such that it extends from the inlet of the first feed passage in a direction toward a leading wall of the platform. The method can also include forming a second feed passage in the platform, an inlet of the second feed passage being open to the first feed passage, wherein the inlet of each branch passage is open to the second feed passage.

Furthermore, a method of cooling a rotor of a turbine in accordance with the teachings of the present disclosure includes directing a flow of cooling fluid (e.g., air) through an inlet in the root of the turbine blade, directing the flow in a radially inward direction along the a leg of a cooling passage within the turbine blade, directing the flow from the leg to an inlet of an arcuate portion, directing a first portion of the flow from the arcuate portion to another leg that extends radially outward, directing a second portion of the flow from the arcuate portion to a first feed passage via an inlet defined in the extrados of the arcuate portion, and directing the second portion of the flow from the first feed passage to a plurality of branch passages and that have outlets open to the exterior of the platform of the turbine blade. In the example provided the method can also include directing the second portion of the flow from the first feed passage to a second feed passage before being directed to the branch passages. Accordingly, the method can also include directing at least some of the second portion of the flow of cooling fluid to flow from the branch passages and impinge on a platform of an adjacent turbine blade when installed on the rotor.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A turbine rotor blade comprising:

an airfoil;

a root; and a platform disposed at an interface between the root and a proximate end portion of the airfoil, wherein the turbine rotor blade defines at least one interior cooling passage having a first leg, a second leg, and an arcuate portion, the arcuate portion disposed at least partially within the platform and connecting the first and second legs, the first leg extending between a distal end portion of the airfoil and an inlet of the arcuate portion, the second leg extending from an outlet of the arcuate portion to the distal end portion of the airfoil, wherein the platform includes a first feed passage and a plurality of branch passages, the first feed passage including an inlet open through an extrados of the arcuate portion, the first feed passage in fluid communication with the plurality of branch passages, wherein each branch passage of the plurality of branch passages has an inlet and an outlet, the inlet of each branch passage being connected for fluid communication with the first feed passage, the outlet of each branch passage being open to an exterior of the platform, wherein the first feed passage extends from the inlet of the first feed passage in a direction toward a leading wall of the platform.

2. The turbine rotor blade according to claim 1, wherein the outlet of at least one branch passage of the plurality of branch passages is open to the exterior of the platform through a top surface of the platform.

3. A turbine rotor blade comprising:

an airfoil;

a root; and a platform disposed at an interface between the root and a proximate end portion of the airfoil, wherein the turbine rotor blade defines at least one interior cooling passage having a first leg, a second leg, and an arcuate portion, the arcuate portion disposed at least partially within the platform and connecting the first and second legs, the first leg extending between a distal end portion of the airfoil and an inlet of the arcuate portion, the second leg extending from an outlet of the arcuate portion to the distal end portion of the airfoil, wherein the platform includes a first feed passage and a plurality of branch passages, the first feed passage including an inlet open through an extrados of the arcuate portion, the first feed passage in fluid communication with the plurality of branch passages, wherein each branch passage of the plurality of branch passages has an inlet and an outlet, the inlet of each branch passage being connected for fluid communication with the first feed passage, the outlet of each branch passage being open to an exterior of the platform, wherein the platform includes a second feed passage, an inlet of the second feed passage being open to the first feed passage, wherein the inlet of each branch passage is open to the second feed passage, wherein the second feed passage includes an outlet open to the exterior of the platform, wherein the platform includes a plug disposed in the outlet of the second feed passage and blocking flow from exiting the platform via the outlet of the second feed passage.

4. A turbine rotor blade comprising:

an airfoil;

a root; and a platform disposed at an interface between the root and a proximate end portion of the airfoil, wherein the turbine rotor blade defines at least one interior cooling passage having a first leg, a second leg, and an arcuate portion, the arcuate portion disposed at least partially within the platform and connecting the first and second legs, the first leg extending between a distal end portion of the airfoil and an inlet of the arcuate portion, the second leg extending from an outlet of the arcuate portion to the distal end portion of the airfoil, wherein the platform includes a first feed passage and a plurality of branch passages, the first feed passage including an inlet open through an extrados of the arcuate portion, the first feed passage in fluid communication with the plurality of branch passages, wherein each branch passage of the plurality of branch passages has an inlet and an outlet, the inlet of each branch passage being connected for fluid communication with the first feed passage, the outlet of each branch passage being open to an exterior of the platform, wherein the first feed passage includes an outlet open to the exterior of the platform, wherein the platform includes a plug disposed in the outlet of the first feed passage and blocking flow from exiting the platform via the outlet of the first feed passage.

5. The turbine rotor blade according to claim 4, wherein the outlet of the first feed passage is located at a leading wall of the platform.

6. A turbine rotor blade comprising:

an airfoil;

a root; and a platform disposed at an interface between the root and a proximate end portion of the airfoil, wherein the turbine rotor blade defines at least one interior cooling passage having a first leg, a second leg, and an arcuate portion, the arcuate portion disposed at least partially within the platform and connecting the first and second legs, the first leg extending between a distal end portion of the airfoil and an inlet of the arcuate portion, the second leg extending from an outlet of the arcuate portion to the distal end portion of the airfoil, wherein the platform includes a first feed passage and a plurality of branch passages, the first feed passage including an inlet open through an extrados of the arcuate portion, the first feed passage in fluid communication with the plurality of branch passages, wherein each branch passage of the plurality of branch passages has an inlet and an outlet, the inlet of each branch passage being connected for fluid communication with the first feed passage, the outlet of each branch passage being open to an exterior of the platform, wherein the outlet of at least one branch passage of the plurality of branch passages is disposed on a suction side wall of the platform.

7. The turbine rotor blade according to claim 6, wherein the inlet of the first feed passage is located radially inward of the plurality of branch passages.

8. The turbine rotor blade according to claim 6, wherein the inlet of the first feed passage is located along the extrados of the arcuate portion closer to the second leg than the first leg.

9. The turbine rotor blade according to claim 6, wherein the platform includes a second feed passage, an inlet of the second feed passage being open to the first feed passage, wherein the inlet of each branch passage is open to the second feed passage.

10. The turbine rotor blade according to claim 9, wherein an entirety of the first feed passage is disposed radially inward of the plurality of branch passages.

11. The turbine rotor blade according to claim 6, wherein the first feed passage extends from the inlet of the first feed passage in a direction toward a leading wall of the platform.

12. A turbine rotor blade comprising:

an airfoil;

a root; and a platform disposed at an interface between the root and a proximate end portion of the airfoil, wherein the turbine rotor blade defines at least one interior cooling passage having a first leg, a second leg, and an arcuate portion, the arcuate portion disposed at least partially within the platform and connecting the first and second legs, the first leg extending between a distal end portion of the airfoil and an inlet of the arcuate portion, the second leg extending from an outlet of the arcuate portion to the distal end portion of the airfoil, wherein the platform includes a first feed passage and a plurality of branch passages, the first feed passage including an inlet open through an extrados of the arcuate portion, the first feed passage in fluid communication with the plurality of branch passages, wherein each branch passage of the plurality of branch passages has an inlet and an outlet, the inlet of each branch passage being connected for fluid communication with the first feed passage, the outlet of each branch passage being open to an exterior of the platform, wherein the outlet of at least one branch passage of the plurality of branch passages is disposed along a portion of the platform that is proximate a leading wall of the platform.

13. The turbine rotor blade according to claim 12, wherein the platform includes a second feed passage, an inlet of the second feed passage being open to the first feed passage, wherein the inlet of each branch passage is open to the second feed passage.

14. The turbine rotor blade according to claim 13, wherein an entirety of the first feed passage is disposed radially inward of the plurality of branch passages.

15. The turbine rotor blade according to claim 12, wherein the first feed passage extends from the inlet of the first feed passage in a direction toward a leading wall of the platform.

16. The turbine rotor blade according to claim 12, wherein the inlet of the first feed passage is located along the extrados of the arcuate portion closer to the second leg than the first leg.

17. The turbine rotor blade according to claim 12, wherein the outlet of at least one branch passage of the plurality of branch passages is disposed on a suction side of the platform relative to the airfoil.

18. The turbine rotor blade according to claim 17, wherein the outlet of each branch passage of the plurality of branch passages is disposed through a suction side wall of the platform.

19. A method of forming a platform cooling arrangement in a turbine rotor blade that includes an airfoil, a root, and a platform disposed at an interface between the root and a proximate end portion of the airfoil, the turbine rotor blade defining an interior cooling passage having a first leg, a second leg, and a curved portion, the curved portion disposed at least partially within the platform and connecting the first and second legs, the first leg extending between a distal end portion of the airfoil and an inlet of the curved portion, the second leg extending from an outlet of the curved portion to the distal end portion of the airfoil, the method comprising:

forming a first feed passage in the platform such that an inlet of the first feed passage is open through an extrados of the curved portion and an outlet of the first feed passage is open to an exterior of the platform;

forming a plurality of branch passages such that each branch passage has an inlet in fluid communication with the first feed passage and an outlet open to an exterior of the platform; and plugging the outlet of the first feed passage to inhibit flow from exiting the platform via the outlet of the first feed passage.

20. The method according to claim 19, further comprising forming a second feed passage in the platform, an inlet of the second feed passage being open to the first feed passage, wherein the inlet of each branch passage is open to the second feed passage.

21. A method of forming a platform cooling arrangement in a turbine rotor blade that includes an airfoil, a root, and a platform disposed at an interface between the root and a proximate end portion of the airfoil, the turbine rotor blade defining an interior cooling passage having a first leg, a second leg, and a curved portion, the curved portion disposed at least partially within the platform and connecting the first and second legs, the first leg extending between a distal end portion of the airfoil and an inlet of the curved portion, the second leg extending from an outlet of the curved portion to the distal end portion of the airfoil, the method comprising:

forming a first feed passage in the platform such that an inlet of the first feed passage is open through an extrados of the curved portion;

forming a plurality of branch passages such that each branch passage has an inlet in fluid communication with the first feed passage and an outlet open to an exterior of the platform, wherein the outlet of at least one branch passage of the plurality of branch passages is arranged on:

a portion of the platform that is proximate a leading wall of the platform, or a suction side wall of the platform, or the suction side wall of the platform proximate the leading wall of the platform.

22. The method according to claim 21, wherein the outlet of the at least one branch passage is arranged on a portion of the platform that is proximate a leading wall of the platform.

23. The method according to claim 21, wherein the outlet of the at least one branch passage is arranged on a suction side wall of the platform.

24. The method according to claim 21, wherein the outlet of the at least one branch passage is arranged on the suction side wall of the platform proximate the leading wall of the platform.

* * * * *